US005904603A

United States Patent [19]

Embry et al.

[11] Patent Number: 5,904,603

[45] Date of Patent: May 18, 1999

[54] LOCKABLE PROPELLER GUARD APPARATUS

[76] Inventors: Sol E. Embry; Nellie Embry, both of 333 Bunger Rd., Ekron, Ky. 40017

[21] Appl. No.: 09/038,120

[22] Filed: Mar. 11, 1998

[51] Int. Cl.[6] ..... B63H 5/16

[52] U.S. Cl. ..... 440/71; 440/900

[58] Field of Search ..... 440/38, 42, 49, 440/67, 71, 72, 76, 113, 900; 114/145 R, 145 A

[56] References Cited

U.S. PATENT DOCUMENTS

| | | | |
|---|---|---|---|
| 4,680,017 | 7/1987 | Eller | 440/66 |
| 4,957,459 | 9/1990 | Snyder | 440/72 |
| 5,273,399 | 12/1993 | Ojeda | 440/900 |
| 5,389,021 | 2/1995 | Padgett | 440/67 |
| 5,469,721 | 11/1995 | Pyle | 440/900 |
| 5,501,622 | 3/1996 | Phelan | 440/71 |
| 5,791,955 | 8/1998 | Rinck | 440/900 |

*Primary Examiner*—Stephen Avila
*Attorney, Agent, or Firm*—Henderson & Sturm

[57] ABSTRACT

A lockable propeller guard apparatus 10 including a shroud member 20 having a distal end 22 dimensioned to encircle the propeller 102, a collar member 30 engageable in the distal end 22 of the shroud member 20 and a cover plate member 40 hingedly connected to the collar member 30 and provided with a locking mechanism 45 for securing the cover plate member 40 to the collar member 30.

8 Claims, 1 Drawing Sheet

10
11
12
13
20
21
22
23
25
26
27
30
31
32
33
34
35
40
41
44
45
100
101
102
200
201

LOCKABLE PROPELLER GUARD APPARATUS

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

BACKGROUND OF THE INVENTION

1. Field of the Invention

The present invention relates to the field of marine safety devices in general, and in particular to lockable propeller guard apparatus.

2. Description of Related Art

As can be seen by reference to the following U.S. Pat. Nos. 4,680,017; 4,957,459; 5,389,021; and 5,501,622, the prior art is replete with myriad and diverse propeller guard devices.

While all of the aforementioned prior art constructions are more than adequate for the basic purpose and function for which they have been specifically designed, they are uniformly deficient with respect to their failure to provide a simple, efficient, and practical lockable propeller guard apparatus that will prevent access to the propeller when the lock mechanism is engaged and which has a removable cover plate member that can be detached from the apparatus when the propeller is in use.

While most cage style propeller guards do an adequate job of eliminating the possibility that the propeller blades will come into direct contact with swimmers, mammals such as manatees, or the like, and other objects, they suffer a major drawback in that the cage structure located downstream of the propeller blades reduces power and also produces unwanted cavitation.

Therefore, the ideal propeller guard apparatus should provide a secure lockable generally solid enclosure that surrounds the propeller when the motor is not in use and which also has a lockable cover element which is removable from the remainder of the apparatus to eliminate any backwash effect from water that has passed through the propeller.

As a consequence of the foregoing situation, there has existed a longstanding need for a new and improved lockable propeller guard apparatus having a removable cover plate member, and the provision of such a construction is a stated objective of the present invention.

BRIEF SUMMARY OF THE INVENTION

Briefly stated, the lockable propeller guard apparatus that forms the basis of the present invention comprises in general, a shroud unit, a collar unit, and a lockable cover unit. The shroud unit is attached to the lower portion of an outboard motor and encircles the propeller. The collar unit is connected to the shroud unit, and the cover unit is hingedly connected to the collar unit.

As will be explained in greater detail further on in the specification, the collar unit is threadedly engaged in one end of the shroud unit and hingedly connected to the cover unit by a unique hinge system. The lockable cover unit comprises a solid one piece cover plate member having a locking mechanism that is adapted to engage a portion of the collar unit which includes a collar member provided with a pair of apertured ears.

The hinge system comprises a pair of spring steel hinge arms that are operatively secured on one end to the cover plate member and releasably connected on the other end to the apertured ears on the collar member. The collar member is further provided with an outwardly projecting element that will only permit the hinge arms from becoming disengaged from the collar member when the cover plate member is disposed generally perpendicular to the collar member.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figures 1, 2, 3:
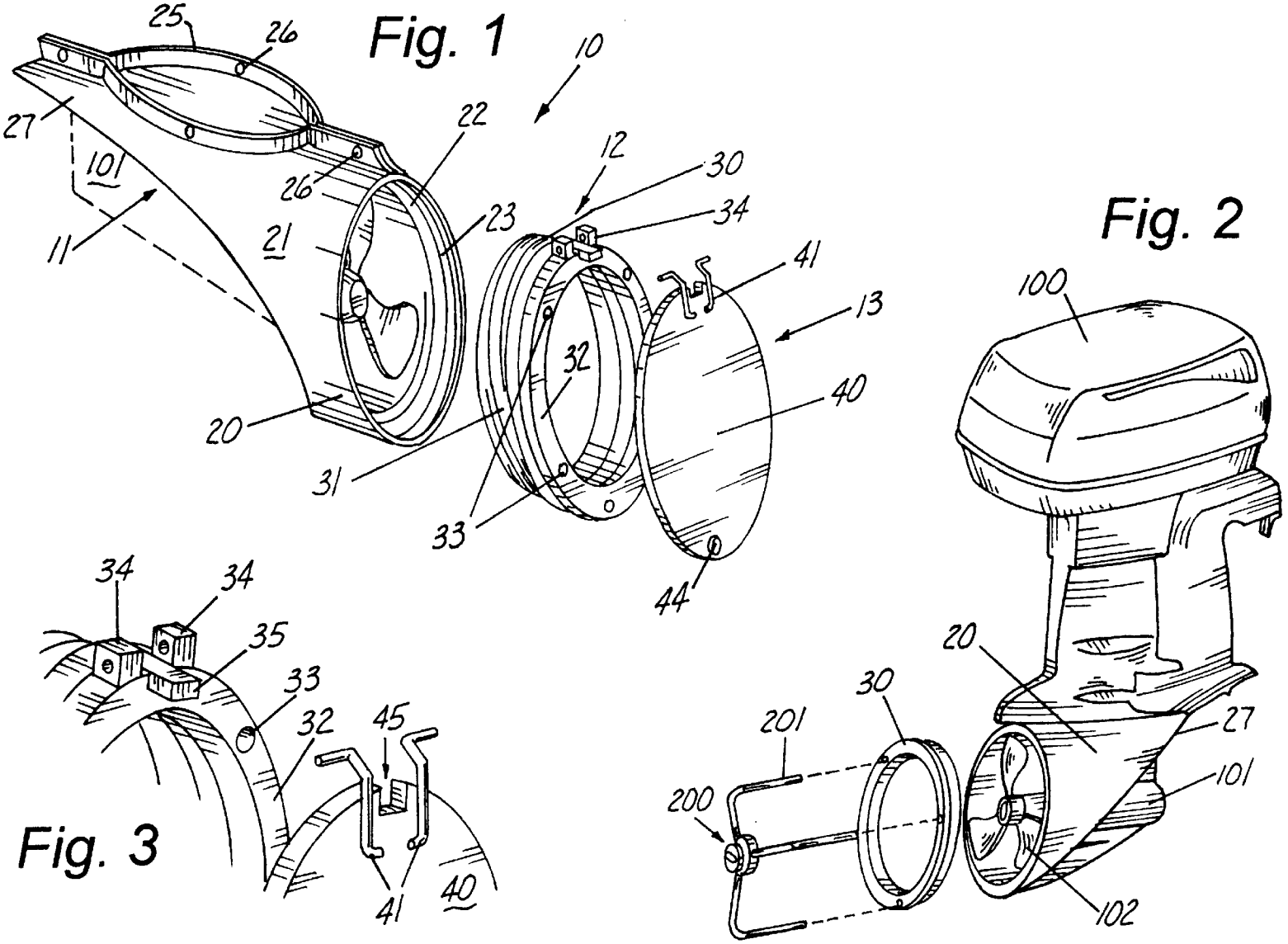
FIG. 1 is an exploded perspective view of the lockable propeller guard apparatus that forms the basis of the present invention.
FIG. 2 is a detail view showing the installation of the collar unit on the shroud unit.
FIG. 3 is an isolated detail view showing the operative engagement between the lockable cover and the collar unit.

As can be seen by reference to the drawings, and in particularly to FIG. 1, the lockable propeller guard apparatus that forms the basis of the present invention is designated generally by the reference number 10. The apparatus 10 comprises in general a propeller shroud unit 11, a collar unit 12, and a lockable cover unit 13. These units will now be described in seriatim fashion.

As can best be seen by reference to FIGS. 1 and 2, the propeller shroud unit 11 comprises a shroud member 20 having a contoured shroud housing 21 designed to partially surround and be attached to the lower portion 101 of an outboard motor 100. The generally cylindrical distal end 22 of the shroud housing 21 encircles the motor propeller 102 and is further provided with an interior threaded portion 23 whose purpose and function will be described presently.

In addition, the upper portion of the shroud housing 21 is provided with an opening 24 dimensioned to receive a portion of the engine 100 and is further provided with a mounting flange 25 having a plurality of apertures 26 dimensioned to receive conventional fasteners (not shown) for attaching the shroud housing 21 to the lower portion of the engine 100 in a well recognized fashion.

Furthermore, the proximal end 27 of the shroud housing 21 is contoured and tapered such that water will be funneled towards the propeller 102 as the engine moves through the water.

Still referring to FIGS. 1 and 2, it can be seen that the collar unit 12 comprises a collar member 30 provided with a reduced diameter threaded portion 31 and a front face 32 having a plurality of mounting recesses 33 formed therein. The recesses 33 are spaced and dimensioned to receive the prongs 201 of a spanner wrench 200 for threadedly engaging the collar member 30 in the distal end 22 of the shroud housing 21.

Turning now to FIG. 3, it can be seen that the upper portion of the collar member 30 is provided with a pair of apertured ear elements 34 and the front face 32 of the collar member 30 is further provided with an outwardly projecting block element 35 that is centrally disposed below the ear elements 34 for reasons that will be explained presently.

As shown in FIGS. 1 and 3, the lockable cover unit 13 comprises a generally flat solid one piece cylindrical cover lid member 40 which is dimensioned to overlie the collar member 30. The cover lid member 40 is designed to be hingedly connected to the collar member 30 by a pair of steel spring hinge arms 41. The steel spring hinge arms 41 are dimensioned to be received on one end in discrete apertures formed in the face of the cover lid member 40. The other end of the hinge arms 41 are dimensioned to be received in the apertured ear elements 34 in the collar member 30.

In addition, the lower end of the cover lid member 40 is provided with a locking mechanism 44 for captively engaging the lower end of the cover lid member 40 to the lower end of the collar member 30 in a well recognized fashion. The upper end of the cover lid member 40 is provided with a slot 45 dimensioned to receive the block element 35 of the collar member 30 when the cover lid member 40 is in the closed position.

By now it should be appreciated that the cover lid member 40 is detachably secured to the collar member 30 by the hinge arms 41 which may be resiliently formed so as to insert the upper ends of the hinge arms 41 into the apertured ear elements 34 on the collar member 30 when the cover lid member 40 is raised to a position generally perpendicular to the collar member 30.

However, when the cover lid member 40 is disposed generally parallel to the collar member 30 in the closed position, the hinge arms 41 cannot be disengaged from the apertured ear elements 34 due to the presence of the block element 35 projecting through the slot 45 and between the hinge arms 41 thereby firmly attaching the cover lid member 40 to the collar member 30 when the locking mechanism 44 is operatively engaged.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooded parts together, whereas, a screw employs a helical surface, in the environment of fastening wooden parts, a nail and a screw may be equivalent structures.

We claim:

1. A lockable propeller guard apparatus for conventional outboard motors having a lower housing provided with a propeller wherein the apparatus comprises:

a shroud unit operatively associated with the lower housing of the motor and including a contoured shroud housing having a distal end dimensioned to encircle said propeller;

a collar member operatively engaged in the distal end of the shroud housing; and a cover plate member dimensioned to overlie the collar member; wherein the cover plate member is hingedly connected to the collar member and also provided with a locking mechanism that is engageable with the collar member.

2. The apparatus as in claim 1 wherein the cover plate member is a solid one-piece member.

3. The apparatus as in claim 1 further comprising:

a pair of hinge arms operatively engaged between the cover plate member and the collar member.

4. The apparatus as in claim 3 wherein the collar member is provided with a pair of apertured ears dimensioned to receive one end of the hinge arms.

5. The apparatus as in claim 4 wherein the cover plate member is provided with a pair of apertures dimensioned to receive the other end of the hinge arms.

6. The apparatus as in claim 3 wherein the hinge arms are fabricated of spring steel.

7. The apparatus as in claim 6 wherein the collar member is provided with an outwardly projecting block element that is dimensioned to be received between the hinge arms.

8. The apparatus as in claim 7 wherein the cover plate member is provided with a slot dimensioned to receive the block element.

* * * * *